United States Patent [19]

Jarman et al.

[11] 4,296,626

[45] Oct. 27, 1981

[54] WHEEL ALIGNMENT APPARATUS

[76] Inventors: Davis R. Jarman, 610 Ward Dr.; Virgil H. Hinson, 206 Fairway Oaks, both of Brunswick, Ga. 31520

[21] Appl. No.: 50,528

[22] Filed: Jun. 21, 1979

[51] Int. Cl.[3] ..... B21D 1/12

[52] U.S. Cl. ..... 72/392; 72/704; 72/705

[58] Field of Search ..... 254/67, 100; 72/704, 72/705, 392

[56] References Cited

U.S. PATENT DOCUMENTS

| | | | |
|---|---|---|---|
| 1,775,968 | 9/1930 | Nelson | 72/705 X |
| 2,664,063 | 12/1953 | Makruski | 72/705 X |
| 3,065,007 | 11/1962 | Colmer, Jr. | 254/67 X |
| 3,556,482 | 1/1971 | Whitney | 72/705 X |
| 3,623,353 | 11/1971 | Dinerman | 72/705 X |
| 3,796,084 | 3/1974 | Jarman | 72/705 X |
| 3,935,725 | 2/1976 | Reischl | 72/451 |
| 4,052,027 | 10/1977 | Taylor | 254/67 X |
| 4,103,531 | 8/1978 | Daniel | 72/704 X |
| 4,117,709 | 10/1978 | Jackson | 72/704 X |
| 4,130,269 | 12/1978 | Schreyer | 254/67 |
| 4,201,076 | 5/1980 | Jarman et al. | 72/705 X |

OTHER PUBLICATIONS

*Padgett Puller* by O'Neal Steel Products Co., pp. 1–4.

*Primary Examiner*—Lowell A. Larson
*Attorney, Agent, or Firm*—Harvey B. Jacobson

[57] ABSTRACT

An alignment system for non-adjustable motor vehicle front end suspension systems, such as those employing McPherson struts, includes anchors for mounting, by appropriate adaptors, to the opposite side forward sheet metal portions of the vehicle to which the upper ends of associated McPherson struts are secured. An elongated adjustable length thrust member is operatively connected between the anchors and a support assembly is provided anchorable relative to one side of the associated vehicle. The support assembly includes an upper portion to which the adjacent alignment system anchor may be connected by means of an adjustable length anchor member and the support further includes an adjustable support member to which the adjacent wheel hub may be releasably anchored. The adjustable length thrust member may be utilized to effect and maintain proper spacing between the McPherson strut anchor points and the adjustable length anchor member and adjustable support member may be utilized to effect simultaneous lateral adjustment of the strut anchor points of the associated vehicle. Also, the adjustable length anchor member and adjustable support member may be utilized to maintain proper positioning of one of the strut anchor points while the adjustable length thrust member connected between the strut anchor points may be utilized to effect proper spacing therebetween, thus also properly locating the upper anchor point of the other strut member.

11 Claims, 15 Drawing Figures

10
12
14
16
18
22
24
26
28
30
32
34
36
38
40
42
44
46
48
50
52
54
56
58
60
62
64
66
68
70
72
74
75
76
78
80
82
84
86
88
90
92
94
170
2
2

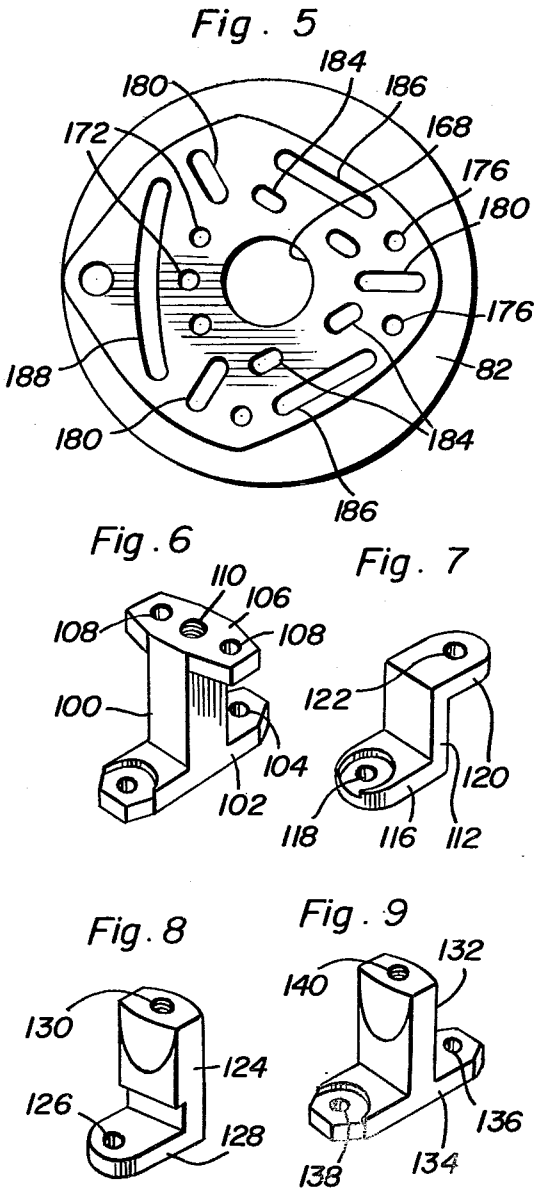
Fig. 5
Fig. 6
Fig. 7
Fig. 8
Fig. 9
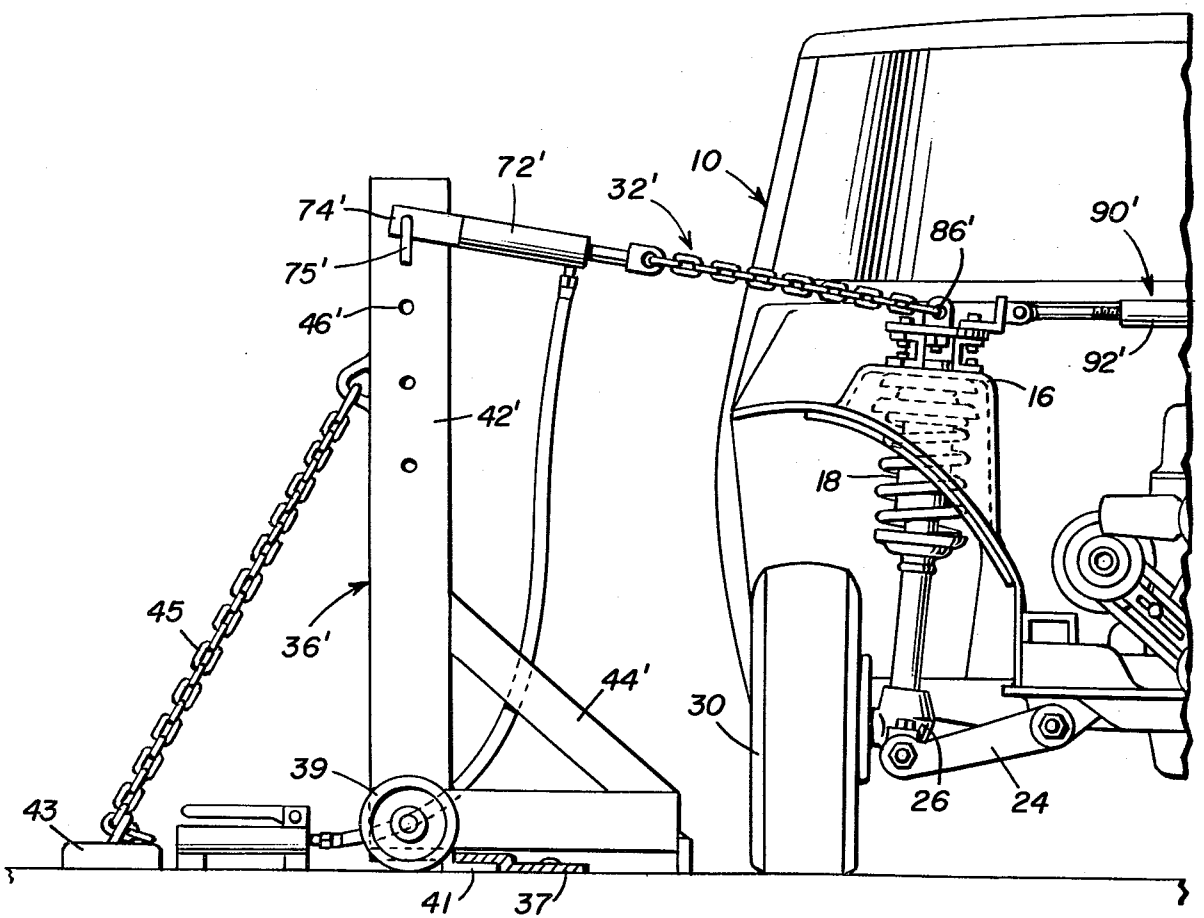
Fig. 3

WHEEL ALIGNMENT APPARATUS

BACKGROUND OF THE INVENTION

The alignment system of the instant invention comprises an adjustable length thrust member for securement between the upper strut end anchor points of the suspension system of a vehicle equipped with McPherson struts whereby the upper spacing between the strut anchor points may be achieved and maintained. In addition, the alignment system includes structure for applying an outward lateral force to either strut anchor point in order that the lateral positioning of the properly spaced strut anchor points may be achieved during body repairs. If the body repairs being carried involve welding or rewelding of any portion of the associated initized body, the strut anchor points are first properly located and the necessary welding operations are thereafter carried out.

Although various forms of upper McPherson strut anchor point positioning structures have been heretofore designed, many of these previously known positioning structures have not been readily operable to precisely reposition and maintain the correct positioning of upper McPherson strut anchor points during subsequent body repairing welding operations to be carried on the vehicle being repaired.

The most closely related known structure to the present invention comprises the front end alignment system disclosed in prior U.S. Pat. No. 4,201,076, patented May 6, 1980. However, the present alignment apparatus constitutes a considerable improvement over the alignment system disclosed in the above-noted prior patent.

The main object of this invention is to provide a front end alignment system which will be capable of precisely locating and maintaining the upper McPherson strut anchor points of a vehicle body during the process of rewelding related components of a unitized vehicle body.

Another object of this invention is to provide a front end alignment system which may be utilized to effect alignment operations on vehicles which are not having unitized body repairs made thereto.

A further object of this invention is to provide a front end alignment system which may be readily utilized in conjunction with substantially all forms of motor vehicle equipped with McPherson strut suspensions.

A final object of this invention to be specifically enumerated herein is to provide a front end alignment system in accordance with the preceding objects and which will conform to conventional forms of manufacture, be of simple construction and easy to use so as to provide a device which will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a fragmentary front schematic view illustrating the manner in which a slightly modified form of the alignment apparatus may be operatively associated with a vehicle front end suspension system;

FIG. 5 is a top plan view of the adaptor plate which may be utilized in conjunction with spacers to define an anchor point on the strut anchor point of an associated vehicle suspension system;

FIGS. 6, 7, 8, 9, 10, 11 and 12 are perspective views illustrating various different forms of spacers which may be utilized to adapt the adaptor plate for anchoring relative to the upper strut anchor point of substantially any vehicle provided with McPherson strut type front suspension;

DETAILED DESCRIPTION OF THE INVENTION

Figures 1, 2:
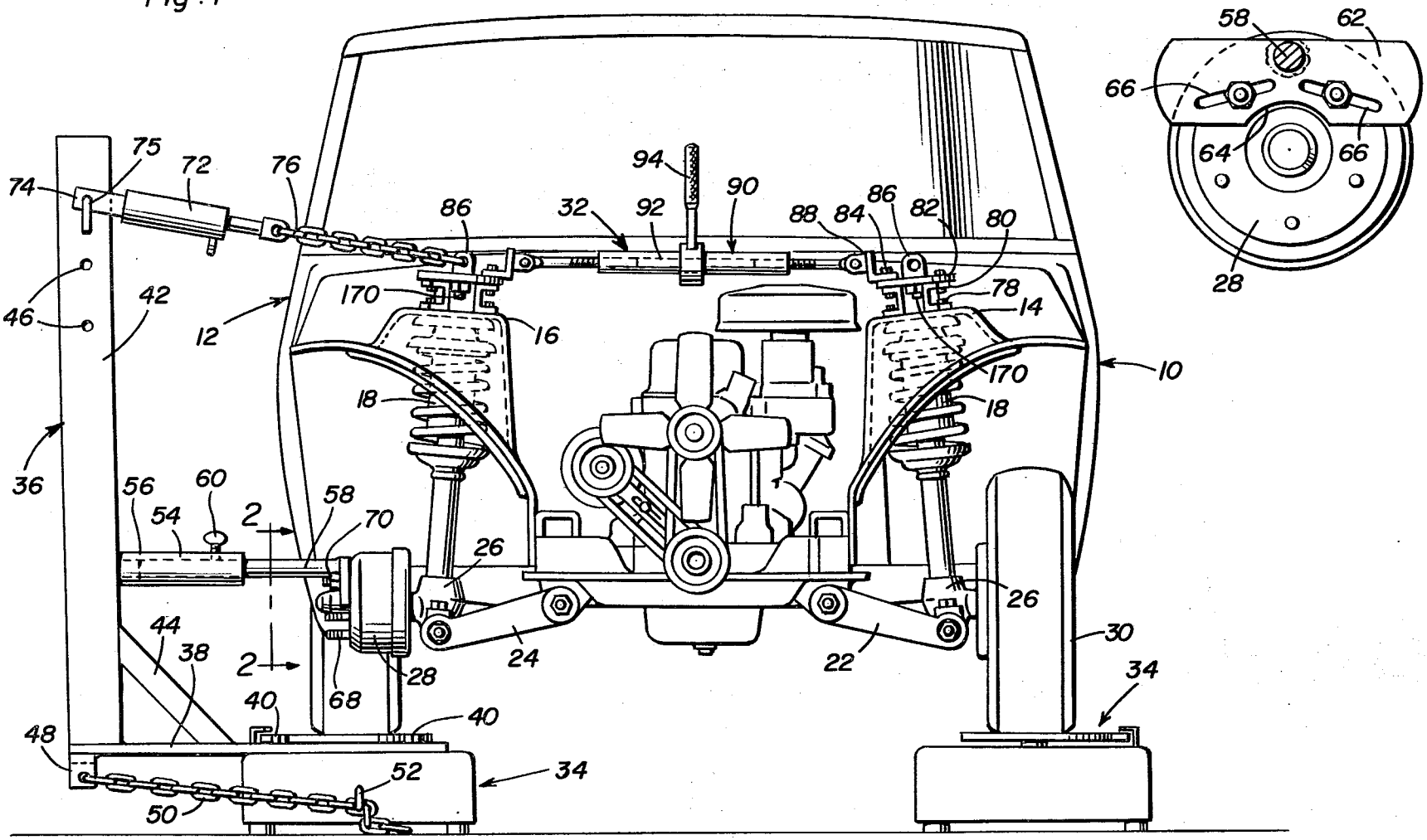
FIG. 1 is a front schematic elevational view of a vehicle equipped with McPherson strut front suspension and with the alignment apparatus of the instant invention operatively associated therewith.
FIG. 2 is an enlarged fragmentary vertical sectional view taken substantially upon the plane indicated by the section line 2—3 of FIG. 1.

Referring now more specifically to the drawings, the numeral 10 generally designates a conventional form of motor vehicle including a unitized body 12. The body 12 includes sheet metal defined opposite side front support towers 14 and 16 from which the upper ends of a pair of McPherson struts 18 are supported, the lower ends of the struts 18 being pivotally anchored relative to the outboard ends of a pair of pivotally mounted lower control arms 22 and 24. The McPherson struts include spindle assemblies 26 from which wheel hubs 28 are journaled and wheel assemblies 30 are mounted on the hubs 28.

When a vehicle such as the vehicle 10 is involved in an accident, the towers 14 and 16 are often shifted out of their proper position resulting in improper camber. Accordingly, in order to properly set the camber of the front wheels 30, it is necessary that the towers 14 and 16 be properly relocated.

The alignment apparatus of the instant invention is referred to in general by the reference numeral 32 and comprises a modification of the front end alignment system disclosed in our co-pending U.S. application Ser. No. 915,808, filed June 15, 1978, now U.S. Pat. No. 4,201,076, patented on May 6, 1980. In addition, the front end alignment system utilizes, for support of the front wheel assemblies 30 of the vehicle 10, a pair of turntable assemblies referred to in general by the reference numerals 34 such as those disclosed in our co-pending U.S. application Ser. No. 915,807, filed June 15, 1978 now U.S. Pat. No. 4,167,816, patented Sept. 18, 1979.

The alignment apparatus includes a support assembly referred to in general by the reference numeral 36 including a lower horizontal plate 38 anchored relative to the upper portion of the turntable assembly 34 in the left-hand portion of FIG. 1 by means of a plurality of fasteners 40. The plate 38 projects horizontally outwardly from the left-hand turntable assembly 34 and includes an upright 42 rigidly supported therefrom and braced relative to the plate 38 by means of a diagonal brace 44. The upper end portion of the upright 42 includes vertically spaced bores 46 and the underside of the plate 38 includes a pair of opposite side depending anchor tabs 48 to which one pair of corresponding ends of a pair of anchor chains 50 are anchored, the other pair of corresponding ends of the anchor chains 50 being anchored relative to hooks 52 supported from the front and rear sides of the left-hand turntable 34 illustrated in FIG. 1.

Also, a rigid brace assembly 54 projects horizontally outwardly of a lower portion of the upright 42 toward the left-hand wheel hub 28 in FIG. 1 from which the wheel assembly 30 has been removed. The brace assembly 54 includes a rigid tubular base arm portion 56 anchored relative to and projecting outwardly from the upright 42 and an extendable arm portion 58 stylingly, telescopingly received within the outer end of the base arm portion 56 and securable in adjusted shifted position relative thereto by means of a threaded set screw 60 supported from the base arm portion 56 and engageable with the extendable arm portion 58. The free end of the extendable arm portion 58 includes a transverse plate 62 supported therefrom including a downwardly opening notch 64 intermediate its opposite ends and adapted to provide clearance for the center outwardly projecting portion of the hub 28. The plate 62 further includes a pair of oppositely inclined slots 66 formed therethrough which may receive the upper wheel mounting studs 68 of the hub 28 therethrough. When the plate 62 is abutted against the outer side of the left-hand wheel hub 28 and the two upper studs 68 are secured through the slots 66 by means of wheel lugs 70, the left-hand spindle assembly 26 is properly anchored relative to the support assembly 36. Although it is not illustrated, a spacer block may be interposed between the upper surface of the turntable 34 and the underside of the left-hand wheel hub 28.

A contractable hydraulic cylinder 72 has one end 74 thereof adjustable anchored to the upright 42 by means of a removable anchor pin 75 passed through the end 74 and one of the bores 46. The other end of the hydraulic cylinder 72 has one end of a tension chain 76 anchored relative thereto.

Each of the towers 14 and 16 has a plurality of bores (not shown) formed therethrough and a plurality of removable fasteners 78 are conventionally secured through the aforementioned bores and the upper ends of the McPherson struts 18 in order to secure the latter to the strut towers 14 and 16. The apparatus 32 includes a plurality of C-shaped spacers 80 (substantially identical to those designated by the reference numerals 42 and 42' in our co-pending U.S. application Ser. No. 915,808) secured atop each of the towers 14 and 16 by the fasteners 78 and a pair of anchor plates 82 are secured atop the spacers 78 by fasteners 84, each of the plates 82 including an upstanding apertured anchor fitting or flange 86. Also, a pair of anchor brackets 88 are secured to the anchor plates 82 by means of one pair of the fasteners 84.

The opposite ends of a turnbuckle-type thrust member referred to in general by the reference numeral 90 are pivotally anchored relative to the anchor brackets 88 and the thrust member includes a threaded center section 92 provided with a ratchet-type handle 94. Accordingly, when the handle 94 is utilized to turn the center section 92, either a pulling thrust may be effected to pull the strut towers 14 and 16 toward each other or a pushing thrust may be exerted on the strut towers 14 and 16 to urge the latter apart.

The end of the chain 76 remote from the hydraulic cylinder 72 is anchored relative to the left-hand anchor flange 86 illustrated in FIG. 1. Thus, the thrust member 90 may be actuated to obtain the desired spacing between the strut towers 14 and 16 and after the desired spacing between the towers 14 and 16 is obtained, the hydraulic cylinder 72 may be actuated to shift both of the towers, simultaneously, to the left as viewed in FIG. 1. Of course, if it is found necessary to shift the towers 14 and 16 to the right as viewed in FIG. 1, the support assembly 36 will be supported from the right-hand turntable assembly 34.

In this manner, the proper lateral spacing between the strut towers 14 and 16 may be obtained and the proper positioning of the strut towers 14 and 16 latterly of the body 12 may also be obtained prior to final repair of the body 12, final repair of the body 12 usually involving welding of replaced portions of the body 12 adjacent the strut towers 14 and 16 in place to thereby maintain the proper positioning of the strut towers 14 and 16.

Figure 15:
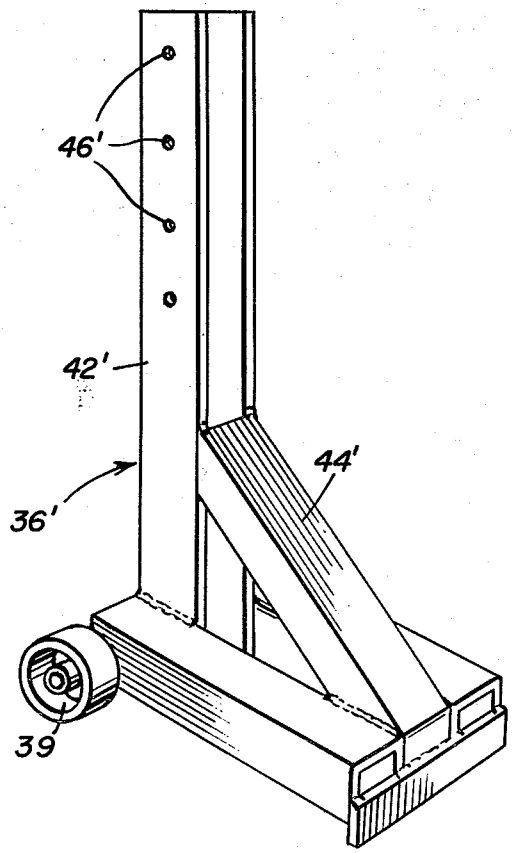
FIG. 15 is a perspective view of the support assembly portion of that form of the invention illustrated in FIG. 3.

With reference now more specifically to FIGS. 3 and 15 of the drawings, there may be seen a modified form of support assembly referred to in general by the reference numeral 36'. When the support assembly 36' is utilized, the wheel assemblies 30 of the vehicle 10 rest upon the floor of the repair area, and the floor of the repair area includes an anchor strip 37 anchored relatively thereto. The lower end of the support assembly 36' includes support wheels 39 and an anchor flange 41 releasably anchored relative to and shiftable along the anchor strip 37. Further, the support assembly 36' is anchored relative to a nearby floor anchor 43 by means of an anchor chain 45. Otherwise, the operation of the first modified form of alignment apparatus illustrated in FIG. 3 and designated by the reference numeral 32' is substantially identical to the operation of the alignment apparatus 32, parts of the alignment apparatus 32' corresponding directly to similar components of the alignment apparatus 32 being designated by prime reference numerals corresponding to those designating the similar components of the apparatus 32.

Figure 4:
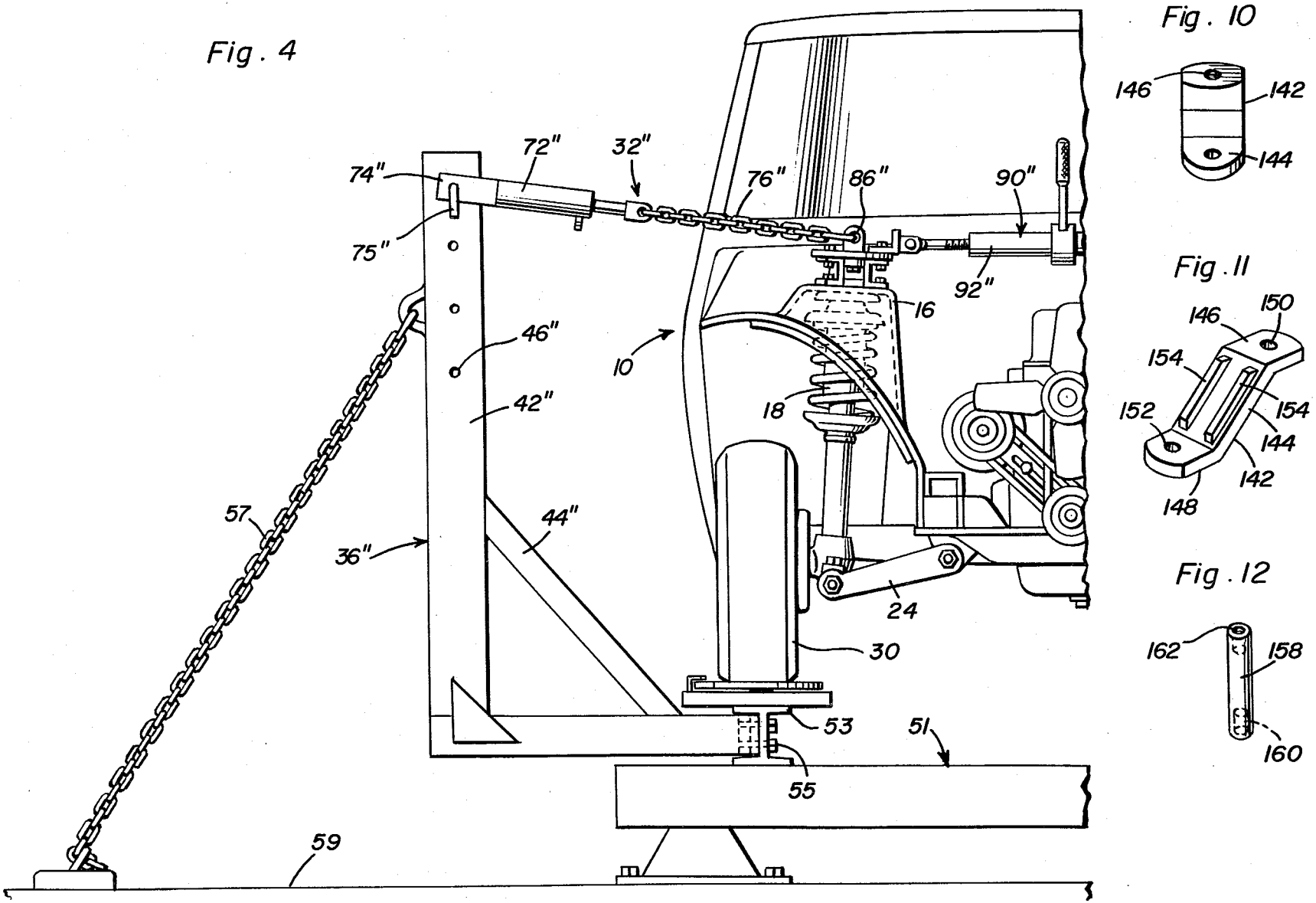
FIG. 4 is a fragmentary front schematic view illustrating the manner in which a further slightly modified third form of the invention may be operatively associated with a vehicle front end suspension system.
Figure 14:
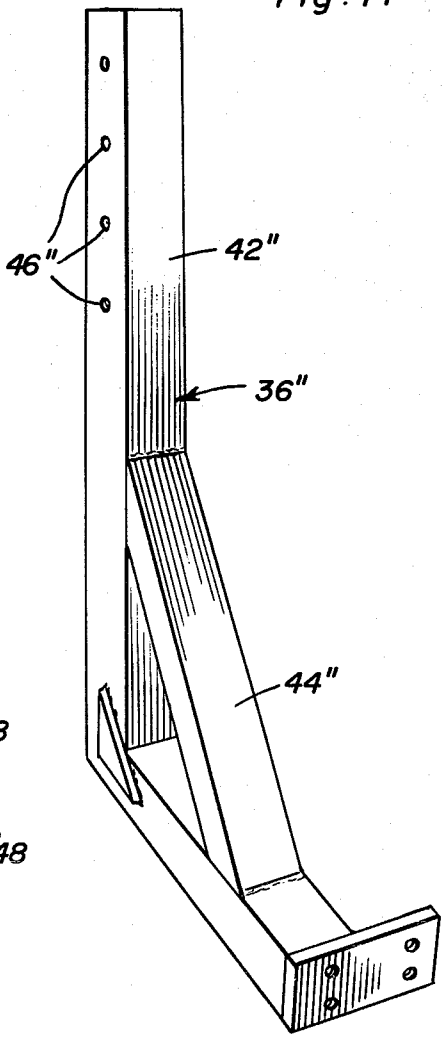
FIG. 14 is a perspective view of the support assembly portion of that form of the invention illustrated in FIG. 4.
Figure 13:
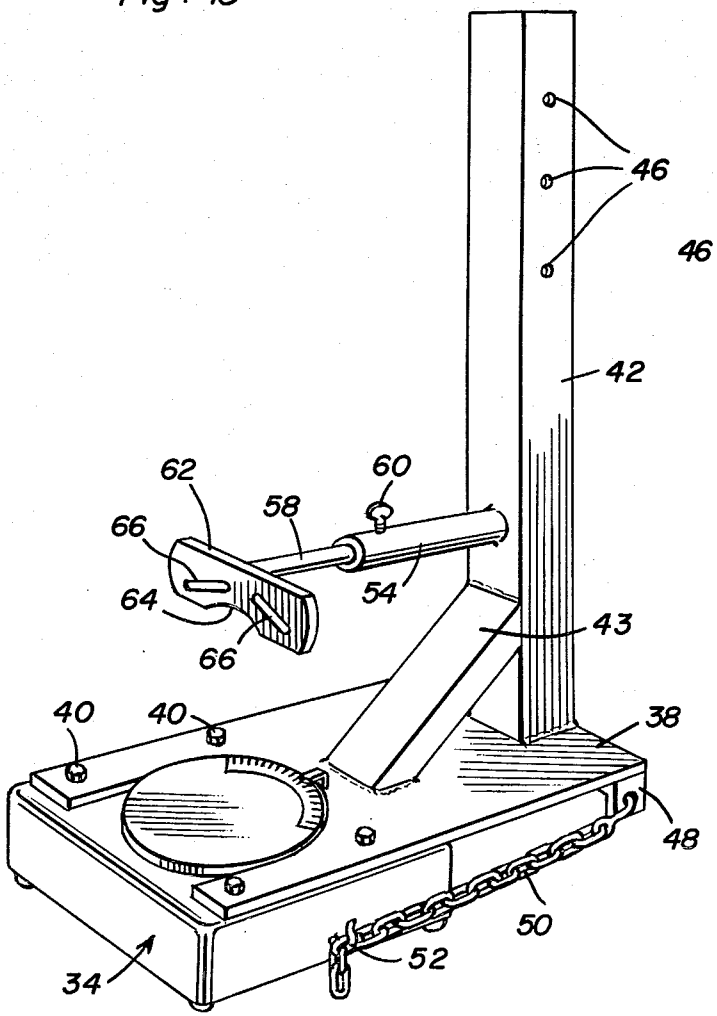
FIG. 13 is a perspective view of the support assembly portion of that form of the invention illustrated in FIG. 1.

With attention invited now more specifically to FIGS. 4 and 14 of the drawings, there may be seen a second modified form of alignment apparatus referred to in general by the reference numeral 32". When the apparatus 32" is utilized, the vehicle 10 has its wheel assemblies 30 supported from an alignment stand assembly referred to in general by the reference numeral 51 and the alignment assembly 32" utilizes a support assembly 36" corresponding to the support assembly 36, but which is bolted to a longitudinal member 53 of the alignment stand assembly 51 by means of suitable bolts 55. In addition, a chain 57 is utilized to anchor the upper portion of the upright 42" of the support assembly 36" to the floor 59 upon which the stand assembly 51 is supported and the various components of the alignment assembly 32" corresponding to similar portions of the assembly 32 are designated by double prime reference numerals corresponding to those designating the various components of the assembly 32.

Referring now more specifically to FIGS. 6–12, there may be seen a plurality of different spacers which may be used in lieu of the spacers 80. A first alternate form of spacer is referred to by the reference numeral 100 in FIG. 6 and includes a horizontal base flange 102 apertured on its opposite ends as at 104 for the reception of the fasteners 78 therethrough. In addition, the upper end of the spacer 100 includes a horizontal flange 106 whose opposite ends are apertured as at 108 and whose midportion is provided with an upwardly opening threaded bore 110. Of course, the apertures 108 and the threaded bore 110 may be utilized to anchor the anchor plate 82 to the corresponding strut tower through the utilization of the fasteners 78 and 84.

A second modified form of spacer is referred to by the reference numeral 112 and illustrated in FIG. 7. The spacer 112 includes a laterally directed base flange 116 which is suitably apertured as at 118 and an opposite laterally directed upper flange 120 which is suitably apertured as at 122. Here again, the spacer 112 may be utilized to support the anchor plate 82 from the corresponding spring tower.

A third L-shaped form of spacer is referred to by the reference numeral 124 in FIG. 8 and the spacer 124 includes an aperture 126 formed through its lower horizontal flange 128 and an upwardly opening threaded blind bore 130 formed in its upper end. A fourth inverted T-shaped form of spacer is referred to by the reference numeral 132 in FIG. 9, the spacer 132 including a lower horizontal flange 134 whose opposite ends are provided with suitable apertures 136 and 138. The spacer 132 also includes an upper end upwardly opening threaded blind bore 140.

In FIG. 10 of the drawings, a further form of spacer is referred to in general by the reference numeral 142 and includes an apertured lower horizontal flange 144 and an upper end upwardly opening threaded bore 146. FIG. 11 illustrates a sixth modified form of spacer 142 having an inclined midportion 144 and upper and lower oppositely directed horizontal flanges 146 and 148 provided with suitable apertures 150 and 152 formed therethrough. The inclined portion 144 is suitably braced by surface bracing members 154 extending upwardly therealong.

A final form of spacer is illustrated in FIG. 12 and designated by the reference number 158. Spacer 158 includes a lower end threaded blind bore 160 as well as an upper end threaded blind bore 162.

With attention now invited more specifically to FIG. 5 of the drawings, it may be seen that anchor plate 82 includes a central large aperture 168 for receiving the threaded anchor shank 170 (see FIG. 1) of a corresponding anchor flange 86 therethrough. In addition, the anchor plate 82 includes a plurality of small bores 172 formed therethrough and spaced about the aperture 168, a plurality of slots 180 formed therein and extending radially of the central area of the anchor plate 82, a plurality of shorter slots 184 formed therein spaced about the aperture 168 and a pair of longer slots 186 spaced thereabout as well as an even longer slot 188 formed therein. The various apertures and slots in the plate 82 adapt the latter to be supported from specifically different strut towers corresponding to the towers 14 and 16 on different makes of automobiles through the utilization of the spacer illustrated in FIGS. 6–12. With the plates 82 and spacers illustrated in FIGS. 6–12, the anchor plates 82 may be supported from the strut towers of substantially all types of vehicles presently using McPherson strut type front suspensions.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

We claim:

1. An alignment apparatus for a motor vehicle front end system including body sheet metal supported upper suspension strut end anchor locations, a pair of adaptor assemblies, said adaptor assemblies including mounting means for removable anchoring to said anchor locations, an elongated adjustable length thrust member of the push and pull type, means pivotally attaching the opposite end portions of said thrust member to said adaptor assemblies, a stand anchorable to the supporting surface for said vehicle on one side of the latter, an elongated pull structure having one end anchored to an upper portion of said stand and the other end thereof anchored to the adjacent adaptor assembly of said vehicle, an intermediate portion of said stand including a horizontally outwardly projecting adjustable length arm supported therefrom, the outer end of said arm including abutment structure for abutting and securement to an adjacent wheel hub of the associated vehicle, said stand being generally L-shaped in configuration including a lower horizontal leg and an upper vertical leg whose lower end is anchored to one end of the lower leg and from an intermediate height portion of which said adjustable length arm is supported, the outer end of said lower horizontal leg including a turntable supported therefrom upon which a wheel supported from said wheel hub may rest.

2. The combination of claim 1 wherein said thrust member includes opposite end sections pivotally attached to said adaptor assemblies and provided with oppositely threaded aligned shank portions projecting toward and spaced from each other, said thrust member also including an intermediate portion defining oppositely outwardly opening and oppositely threaded bores in which said shank portions are threaded.

3. The combination of claim 1 wherein each of said adaptor assemblies includes an anchor plate defining a central area and a plurality of variously spaced bores and slots in said plate disposed about said central area, said central area including an anchor fitting supported therefrom to which the corresponding end of said thrust member is pivotally attached.

4. The combination of claim 1 wherein each of said adaptor assemblies comprises an anchor plate to which the corresponding end portion of said adjustable length thrust member is secured, said mounting means including a plurality of upstanding anchor spacers including fastener receiver means on their upper and lower ends, said lower ends of said anchor spacers being supportable atop the associated upper suspension strut end anchor locations for securement thereto by fasteners received through the lower fastener receiver means, said anchor plate overlying the upper ends of said anchor spacers and having fastener receiving openings formed therethrough and fasterners secured through said fastener receiving openings and engaged with said fastener receiver means of said upper ends to secure said plate atop said upstanding anchor spacers.

5. The combination of claim 4 wherein said upstanding anchor spacers include upper and lower vertically apertured horizontally elongated flanges, the upper flanges being angularly displaced generally 90° relative to the lower flanges, said fastener receiver means being formed in said upper and lower flanges.

6. The combination of claim 4 wherein said upstanding anchor spacers include upper and lower horizontal flange portions defining said upper and lower fastener receiver means and an upstanding portion extending between said flange portions, said flange portions projecting outwardly from said upstanding portion in opposite directions therefrom.

7. The combination of claim 4 wherein said upstanding anchor spacers are generally L-shaped in configuration including a lower horizontal flange and an upstanding portion secured at its lower end to one end of said horizontal flange, said fastener receiver means being formed in the upper end of said upstanding portion and said horizontal flange.

8. The combination of claim 4 wherein said upstanding anchor spacers are substantially inverted T-shaped in configuration including a lower horizontal flange portion and an upright portion projecting upwardly from said lower horizontal flange portion centrally intermediate the opposite ends thereof, said fastener receiver means being formed in said lower horizontal flange portion and the upper end of said upstanding portion.

9. The combination of claim 4 wherein said upstanding anchor spacers include lower horizontal flange portions and upwardly projecting block portions formed on corresponding ends of said lower horizontal flange portions, said fastener receiver means being formed in said lower horizontal flange portions and the upper portions of said block portions.

10. The combination of claim 4 wherein said anchor spacers include upper and lower horizontal flange portions interconnected by means of an inclined riser portion extending and secured therebetween, said fastener receiver means being formed in said upper and lower flange portions.

11. The combination of claim 6 wherein said upstanding anchor spacers comprise upright members including upper and lower ends in which said fastener receiver means are formed, said fastener receiver means including upper and lower blind threaded bores opening upwardly and downwardly from the upper and lower ends of said upright members.

* * * * *